US010431155B2

(12) United States Patent
Moon et al.

(10) Patent No.: US 10,431,155 B2
(45) Date of Patent: Oct. 1, 2019

(54) DISPLAY DEVICE WITH DEGRADATION COMPENSATION BASED ON SENSING DATA AND METHOD OF DRIVING THE SAME

(71) Applicant: SAMSUNG DISPLAY CO., LTD., Yongin-si, Gyeonggi-do (KR)

(72) Inventors: Seung-Hyun Moon, Hwaseong-si (KR); Dong-Won Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 42 days.

(21) Appl. No.: 15/624,604

(22) Filed: Jun. 15, 2017

(65) Prior Publication Data

US 2018/0020525 A1 Jan. 18, 2018

(30) Foreign Application Priority Data

Jul. 18, 2016 (KR) ..... 10-2016-0090604

(51) Int. Cl.

| | |
|---|---|
| ***G09G 3/32*** | (2016.01) |
| ***G09G 3/3233*** | (2016.01) |
| ***H05B 33/08*** | (2006.01) |
| ***G09G 5/10*** | (2006.01) |
| ***H01J 1/62*** | (2006.01) |
| *G09G 3/3208* | (2016.01) |

(52) U.S. Cl.

CPC ..... *G09G 3/3233* (2013.01); *G09G 5/10* (2013.01); *H01J 1/62* (2013.01); *H05B 33/0896* (2013.01); *G09G 3/3208* (2013.01); *G09G 2300/0809* (2013.01); *G09G 2300/0819* (2013.01); *G09G 2320/0285* (2013.01); *G09G 2320/043* (2013.01); *G09G 2330/12* (2013.01)

(58) Field of Classification Search

CPC ..... G09G 3/3208; G09G 3/3233; G09G 2320/0285; G09G 2320/043; G09G 2320/0233; G09G 2320/029; G09G 2320/045

See application file for complete search history.

(56) References Cited

U.S. PATENT DOCUMENTS

2014/0176409 A1* 6/2014 Kim ..... G09G 3/3233 345/92

FOREIGN PATENT DOCUMENTS

KR 10-2014-0119419 A 10/2014
KR 10-2016-0041132 A 4/2016

* cited by examiner

*Primary Examiner* — Xuemei Zheng
(74) *Attorney, Agent, or Firm* — Lewis Roca Rothgerber Christie LLP

(57) ABSTRACT

A display device includes a display panel including pixels; a sensor configured to generate sensing data by measuring a current flowing through each of the pixels based on a reference voltage; and a compensator to generate stress data by calculating stress of the pixels based on input data provided from an external component and to generate degradation data by compensating a variation of the sensing data based on the stress data.

18 Claims, 9 Drawing Sheets

FIG. 5B

MAP_S4

| | 1 | 2 | 3 | 4 |
|---|---|---|---|---|
| 1 | 54 | 54 | 54 | 53 |
| 2 | 53 | 51 | 51 | 48 |
| 3 | 53 | 50 | 48 | 48 |

MAP_S5

| | | | | | | | | | | | |
|---|---|---|---|---|---|---|---|---|---|---|---|
| 55 | 55 | 55 | 55 | 55 | 55 | 55 | 55 | 55 | 54 | 54 | 54 |
| 55 | 54 | 54 | 54 | 54 | 54 | 54 | 54 | 54 | 53 | 53 | 53 |
| 54 | 54 | 53 | 53 | 53 | 53 | 53 | 53 | 52 | 52 | 51 | 52 |
| 53 | 53 | 53 | 52 | 52 | 52 | 52 | 52 | 51 | 51 | 49 | 49 |
| 53 | 53 | 52 | 51 | 51 | 51 | 51 | 51 | 50 | 49 | 48 | 48 |
| 53 | 53 | 52 | 51 | 51 | 50 | 50 | 49 | 48 | 48 | 48 | 48 |
| 53 | 53 | 52 | 51 | 50 | 50 | 49 | 48 | 48 | 48 | 48 | 48 |
| 53 | 53 | 52 | 51 | 50 | 49 | 48 | 48 | 48 | 48 | 48 | 48 |
| 53 | 53 | 52 | 51 | 50 | 49 | 48 | 48 | 48 | 48 | 48 | 48 |

DISPLAY DEVICE WITH DEGRADATION COMPENSATION BASED ON SENSING DATA AND METHOD OF DRIVING THE SAME

CROSS-REFERENCE TO RELATED APPLICATION

This application claims priority to and the benefit of Korean Patent Application No. 10-2016-0090604, filed on Jul. 18, 2016 in the Korean Intellectual Property Office (KIPO), the content of which is incorporated herein in its entirety by reference.

BACKGROUND

1. Field

Example embodiments relate to a display device. More particularly, embodiments of the present inventive concept relate to a display device that can compensate pixel degradation and a method of driving the display device.

2. Description of the Related Art

An organic light emitting display device displays an image using an organic light emitting diode. The organic light emitting diode and a driving transistor that transfers a current to the organic light emitting diode may be degraded as the organic light emitting diode and the driving transistor operate. The organic light emitting display device may not display an image with desired luminance due to degradation of the organic light emitting diode and degradation of the driving transistor (i.e., referred to as "pixel degradation").

A related art organic light emitting display device provides a reference voltage to pixels, generates sensing data by measuring a current (i.e., a driving current) flowing through each of the pixels in response to the reference voltage, and calculates pixel degradation amount for each of the pixels based on the sensing data and predetermined reference data (e.g., data including currents measured in a manufacturing process of the organic light emitting display device). However, the pixel degradation amount may not be accurate because a driving condition (e.g., temperature) for the sensing data is different from a driving condition for the predetermined reference data.

In addition, the related art organic light emitting display device calculates pixel degradation amount (i.e., relative pixel degradation amount) of a second pixel which is more degraded with respect to pixel degradation amount of a first pixel which is less degraded than the second pixel. However, a current changing characteristic of pixels varies according to locations of the pixels. Therefore, accuracy of the calculated pixel degradation amount of the second pixel decreases as a distance between the first pixel and the second pixel increases.

SUMMARY

Aspects of some example embodiments are directed toward an organic light emitting display device that can accurately compensate pixel degradation.

Aspects of some example embodiments are directed toward a method of driving the display device.

According to example embodiments, a display device may include a display panel including pixels; a sensor configured to generate sensing data by measuring a current flowing through each of the pixels based on a reference voltage; and a compensator configured to generate stress data by calculating a stress of the pixels based on input data provided from an external component and to generate degradation data by compensating a variation of the sensing data based on the stress data.

In example embodiments, the variation of the sensing data may vary depending on at least one of characteristic variation of the pixels and a driving condition of the display device.

In example embodiments, the compensator may divide the pixels into groups using a first block having a first size, may generate first reference data by calculating first reference values for the groups based on first pixels having a first stress value among the stress data, and may compensate the variation of the sensing data based on the first reference data.

In example embodiments, the first stress value may be the most distributed in the stress data.

In example embodiments, the first stress value may be the smallest value in the stress data.

In example embodiments, the compensator may calculate the first reference values by averaging sensed current values corresponding to the first pixels in the sensing data for each of the groups.

In example embodiments, the compensator may generate second reference data by calculating second reference values for the groups based on second pixels having a second stress value among the stress data and may compensate the first reference data based on the second reference data.

In example embodiments, the compensator may calculate differences between the first reference values and the second reference values corresponding to respective groups and may compensate the first reference data based on the differences.

In example embodiments, the compensator may select a first group having a first valid value in the first reference data and a second valid value in the second reference data, may calculate a first difference between the first valid value and the second valid value, may select a second group having a first invalid value in the first reference data and a third valid value in the second reference data, may calculate a first compensation value by compensating the third valid value based on the first difference, and may update the first reference data by compensating the first invalid value based on the first compensation value.

In example embodiments, the compensator may select a third group having a second invalid value in the first reference data, may select a fourth group adjacent to the third group and having a fourth valid value in the first reference data, and may update the first reference data by compensating the second invalid value based on the fourth valid value.

In example embodiments, the compensator may generate first supplementary data based on a second block having a second size and may compensate the first reference data based on the first supplementary data.

In example embodiments, the compensator may compensate the first reference data to have a resolution which is equal to a resolution of the sensing data by interpolating the first reference values based on the pixels.

In example embodiments, the compensator may generate the degradation data by subtracting the first reference data from the sensing data.

In example embodiments, the compensator may generate the degradation data when the display device is initially driven.

In example embodiments, the display device may further include a data driver configured to generate a data signal based on converted data and to provide the data signal to the pixels. Here, the compensator may generate the converted data by compensating the input data based on the degradation data.

According to example embodiments, a method of driving a display device including pixels may include generating stress data by calculating a stress of each of the pixels based on input data provided form an external component; generating sensing data by measuring a current flowing through each of the pixels in response to a reference voltage; generating degradation data by compensating a variation of the sensing data based on the stress data; and compensating degradation of the pixels based on the degradation data.

In example embodiments, generating the degradation data may include dividing the pixels into groups using a first block having a first size; generating first reference data by calculating first reference values for the groups based on first pixels having a first stress value of the stress data; and compensating the variation of the sensing data based on the first reference data.

In example embodiments, generating the first reference data may include generating second reference data by calculating second reference values for the groups based on second pixels having a second stress value of the stress data; and compensating the first reference data based on the second reference data.

In example embodiments, generating the first reference data may further include compensating an invalid value of the first reference data based on a valid value of an adjacent group. Here, the adjacent group may be adjacent to a target group corresponding to the invalid value.

In example embodiments, generating the first reference data may include compensating the first reference data to have a resolution which is equal to a resolution of the sensing data by interpolating the first reference values based on the pixels.

Therefore, a display device according to example embodiments may accurately compensate pixel degradation based on degradation data by compensating a variation of sensing data (e.g., a variation due to characteristic variation of pixels in the display device and/or due to a driving condition of the display device) based on stress data and by generating the degradation data based on the compensated sensing data.

In addition, a method of driving a display device according to example embodiments may efficiently drive the display device by compensating a variation of sensing data.

BRIEF DESCRIPTION OF THE DRAWINGS

Illustrative, non-limiting example embodiments will be more clearly understood from the following detailed description taken in conjunction with the accompanying drawings.

FIG. 5B is a diagram illustrating an example of reference data generated by the compensator of FIG. 3.

DETAILED DESCRIPTION

Hereinafter, example embodiments according to the present inventive concept will be explained in more detail with reference to the accompanying drawings.

Figure 1:
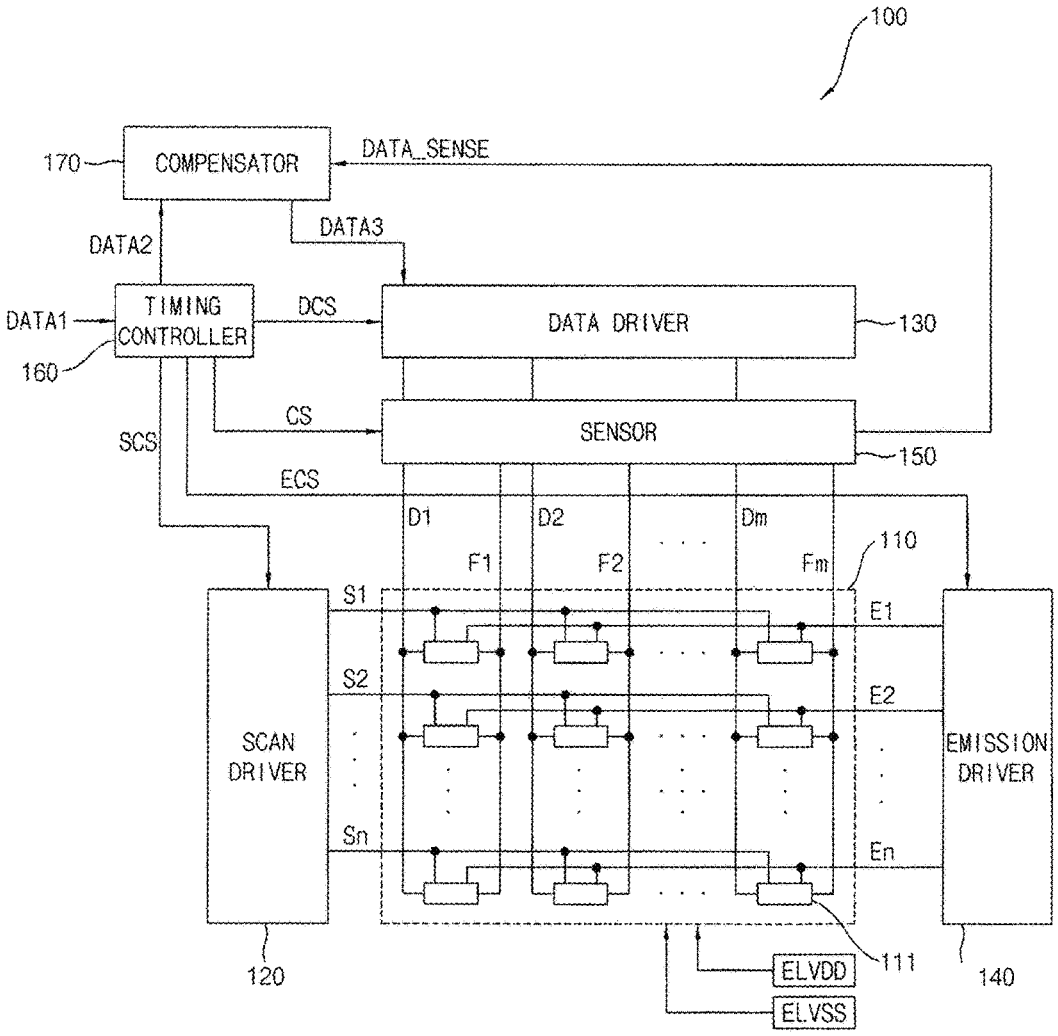
FIG. 1 is a block diagram illustrating a display device according to example embodiments.

FIG. 1 is a block diagram illustrating a display device according to example embodiments.

Referring to FIG. 1, the display device 100 may include a display panel 110, a scan driver 120, a data driver 130, an emission driver 140, a sensor 150, a timing controller 160, and a compensator 170. The display device 100 may display an image based on image data (e.g., first data DATA1) provided from an external component (e.g., an application processor). For example, the display device 100 may be an organic light emitting display device.

The display panel 110 may include scan lines S1 through Sn, data lines D1 through Dm, feedback lines F1 through Fm, and pixels 111, where each of m and n is an integer greater than or equal to 2. The display panel 110 may include light emitting control lines E1 through En. The pixels 111 may be respectively disposed in cross-regions of the scan lines S1 through Sn, the data lines D1 through Dm, and the feedback lines F1 through Fm.

Each of the pixels 111 may store a data signal in response to a scan signal, and may emit light based on the stored data signal. For example, each of the pixels 111 may include a light emitting diode, a driving transistor which controls an amount of a current flowing through the organic light emitting diode based on a voltage provided to a gate electrode, a switching transistor which provides the data signal to the gate electrode of the driving transistor in response to the scan signal, and a storage capacitor which stores the data signal provided to the gate electrode of the driving transistor. In addition, each of the pixels 111 may be electrically connected between a terminal (e.g., an anode) of the organic light emitting diode and a feedback line (e.g., one of the feedback lines F1 through Fm) and may further include a sensing transistor to be turned on in response to a sensing control signal.

The scan driver 120 may generate the scan signal based on a scan driving control signal SCS. The scan driving control signal SCS may be provided from the timing controller 160 to the scan driver 120. The scan driving control signal SCS may include a start pulse and clock signals, and the scan driver 120 may include shift registers sequentially generating the scan signal based on the start pulse and the clock signals.

The data driver 130 may generate the data signal based on a data driving control signal DCS and an image data (e.g., third data DATA3). The data driver 130 may provide the data signal to the display panel 110 in response to the data driving control signal DCS. The data driving control signal DCS may be provided from the timing controller 160 to the data driver 130. The image data may be provided to the data driver 130 from the compensator 170 or the timing controller 160.

The emission driver 140 may generate a light emission control signal based on a light emission driving control signal ECS. The light emission driving control signal ECS may be provided from the timing controller 160 to the emission driver 140. The emission driver 140 may generate the light emission control signal based on the light emission driving control signal ECS and clock signals, simultaneously, concurrently, or sequentially.

The sensor 150 may be electrically connected to the feedback lines F1 through Fm and may measure (or detect, sense) characteristics of the pixels 111 based on a control signal CS. Here, the control signal CS may be provided from the timing controller 160 to the sensor 150. The characteristics of the pixels 111 may be (may include) a characteristic of a light emitting element included in each of the pixels 111, and the characteristics of the pixels 111 may include at least one among a current-voltage characteristic of the light emitting element, a voltage-luminance characteristic of the light emitting element (e.g., a light emitting diode, an organic light emitting diode), and an impedance (or resistance, capacitance) characteristic of the light emitting element.

In some example embodiments, the sensor 150 may provide a reference voltage (or a sensing voltage) to the feedback line (e.g., an mth feedback line Fm) in response to the control signal CS and may generate sensing data DATA_SENSE by integrating a current fed back (passing) through the feedback line in response to the reference voltage. For example, the sensor 150 may include an amplifier, an integrating capacitor, and a switch. When the sensing transistor in a pixel (e.g., one of the pixels 111) is turned on, a current flowing path may be formed form the amplifier through the feedback line to the organic light emitting diode, and a feedback current may flow from an output terminal of the amplifier through to the organic light emitting diode through the integrating capacitor and the feedback line. The sensor 150 may integrate the feedback current using the integrating capacitor and may generate the sensing data DATA_SENSE by sampling the integrated feedback current (e.g., a measured voltage).

The timing controller 160 may control the scan driver 120, the data driver 130, the emission driver 140, and sensor 150. The timing controller 160 may generate the scan driving control signal SCS, the data driving control signal DCS, the light emission driving control signal ECS, and the control signal CS, and may control the scan driver 120, the data driver 130, the emission driver 140, and the sensor 150 based on the generated signals, respectively.

The compensator 170 may calculate an amount of a pixel degradation of each of the pixels 111 based on the input data (e.g., second data DATA2) and the sensing data DATA_SENSE.

In some example embodiments, the compensator 170 may generate stress data by calculating stress of the pixels 111 based on the input data. Here, the stress may represent a degree of pixel use and may be calculated by accumulating grayscale values corresponding to the pixels. For example, the stress of the pixels 111 may be proportional to a driving time of the pixels 111 and grayscale values (e.g., an average grayscale value). The stress data may include stress values which are calculated for each of the pixels 111.

In some example embodiments, the compensator 170 may generate degradation data (e.g., data including or indicating an amount of pixel degradation) by compensating a variation of the sensing data DATA_SENSE based on the stress data. Here, the variation of the sensing data DATA_SENSE may be represented based on a characteristic variation of the pixels 111, a driving condition of the display device 100 (e.g., a temperature), etc. The pixels 111 may be different from each other, for example, the voltage-current characteristic of the pixels (e.g., a change ratio of a current and a voltage) may be different from each other, and degradation amounts of the pixels 111 may be different from each other in the same condition. The sensing data may include the variation due to the characteristic variations of the pixels 111 and due to a change of the driving condition (or a second condition). Therefore, the variation of the sensing data may be compensated for an accuracy compensation of the pixel degradation.

In some example embodiments, the compensator 170 may categorize (or distribute) the pixels 111 into groups (or pixel groups) based on a first block having a first size, may generate first reference data by calculating first reference values for each of the groups based on the first pixels (or first pixel group) which have a first stress value among the stress data DATA_STRESS, and may compensate the variation of the sensing data DATA_SENSE based on the first reference data. For example, the compensator 170 may determine (or set) a compensation reference (or a reference value) for each of the groups based on pixels which are the least degraded (e.g., pixels corresponding to the lowest stress value among the stress data) and may compensate the variation of the sensing data DATA_SENSE based on the compensation reference. In addition, the compensator 170 may generate second reference data by calculating second reference values for each of the group based on second pixels which have a second value among the stress data DATA_STRESS and may compensate the first reference data based on the second reference data. For example, when the compensator 170 determines that a compensation reference set based on the first pixels is not appropriate (e.g., when the compensation reference includes an invalid value), the compensator 170 may compensate the compensation reference based on the second pixels (e.g., pixels which are different from the first pixels and which are relatively more degraded).

A configuration of compensating the variation of the sensing data DATA_SENSE by the compensator 170 will be described with reference to FIGS. 2 through 6.

As described above, the display device 100 according to example embodiments may generate the degradation data by compensating the variation of the sensing data DATA_SENSE based on the stress data. Therefore, the display device 100 may compensate the pixel degradation (or compensate for the pixel degradation) accurately based on the degradation data even through the driving condition of the display device 100 is changed.

It is illustrated in FIG. 1 that the display panel 110 includes the feedback lines F1 through Fm and that the sensor 150 is electrically connected to the feedback lines F1 through Fm. However, the display panel 110 is not limited thereto. For example, the display panel 110 may include no feedback lines and may use the data lines D1 through Dm as the feedback lines F1 through Fm using time-division driving of the data lines D1 through Dm.

In addition, it is illustrated in FIG. 1 that the compensator 170 is included in the display device 100 independent of other component. However, the compensator 170 is not limited thereto. For example, the compensator 170 may be included in the timing controller 160 or a driving integrated circuit (e.g., an integrated circuit including one of the scan driver 120, the data driver 130, and the emission driver 140).

Figure 2:
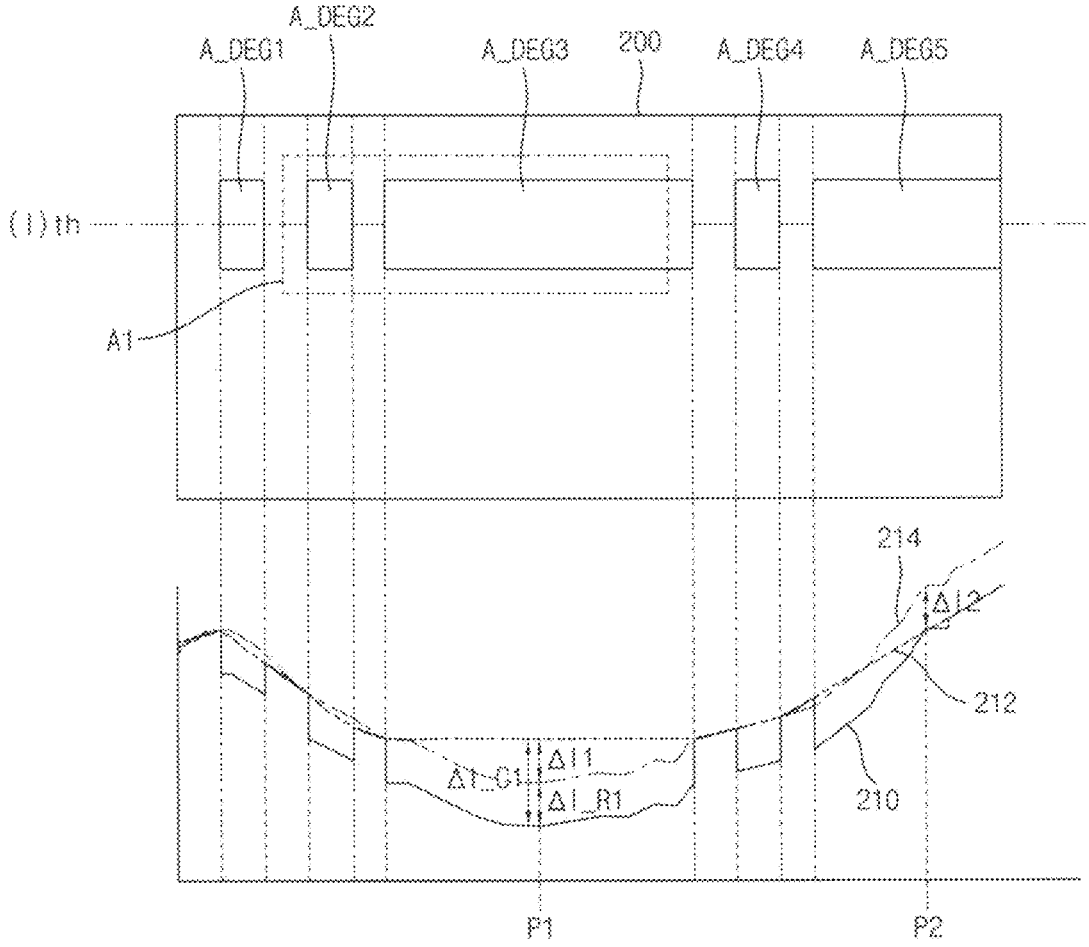
FIG. 2 is a diagram illustrating an example of sensing data generated by the display device of FIG. 1.

FIG. 2 is a diagram illustrating an example of sensing data generated by the display device of FIG. 1.

Referring to FIGS. 1 and 2, a display panel 200 may be the same as the display panel 110 described with reference to FIG. 1 and may include first through fifth degradation areas A_DEG1 through A_DEG5 which are arranged along a ith pixel row, where i is a positive integer.

A first graph 210 may represent sensing values corresponding to the ith pixel row among the sensing data DATA_SENSE generated by the sensor 150. A second graph 212 may represent a reference line calculated by a conventional display device. A third graph 214 may represent a real reference line. Here, a reference line may be a reference which is used to calculate degradation data (or an amount of pixel degradation) based on the sensing data DATA_SENSE and may include sensing values (or current values) of pixels which are not degraded (or of pixels which are relatively less degraded).

The second graph 212 may be set (or generated) based on the pixels which are not degraded (or the pixels which are relatively less degraded). Here, the second graph 212 may have values which are equal to values of the third graph 214 in degradation regions which have a relatively narrow width such as the first degradation area A_DEG1, the second degradation area A_DEG2, and the fourth degradation area A_DEG4. Therefore, calculated pixel degradation (or calculated amount of the pixel degradation) based on the second graph 212 may be equal to or similar to a real pixel degradation (or real amount of the pixel degradation) (e.g., pixel degradation calculated based on the third graph 214) for the first degradation area A_DEG1, the second degradation area A_DEG2, and the fourth degradation area A_DEG4. That is, the pixel degradation may be compensated accurately.

However, the second graph 212 may be different from the third graph 214 in a degradation region having a relatively wide width such as the third degradation area A_DEG3 and in a degradation region having a non-degraded pixel such as the fifth degradation area A_DEG5. For example, the second graph 212 may be greater than the third graph 214 by a first error ΔI1 at a first point P1. Here, a first calculated pixel degradation ΔI_C1 calculated based on the second graph 212 may have the first error ΔI1 with respect to a first real pixel degradation ΔI_R1 at the first point P1. Therefore, the pixel degradation may be inaccurately compensated based on the second graph 212.

Similarly, the second graph 212 may be less than the third graph 214 by a second error ΔI2 at a second point P2 such that the pixel degradation may be inaccurately compensated based on the second graph 212.

The display device 100 according to example embodiments may divide the pixels 111 (or the display panel 200) into groups (or blocks, regions) based on a first block having a first size, may generate first reference data (e.g., including values similar to the values of the second graph 212) by calculating first reference values for each of the groups based on first pixels having a first stress value among the stress data DATA_STRESS, may generate second reference data by calculating second reference values for each of the groups based on second pixels having a second stress value among the stress data DATA_STRESS, may compensate the first reference data based on the second reference data (e.g., may compensate the first reference data based on the second reference data in the third degradation area A_DEG3), and may compensate a variation of the sensing data DATA_SENSE based on the first reference data (or the compensated first reference data).

Figure 3:
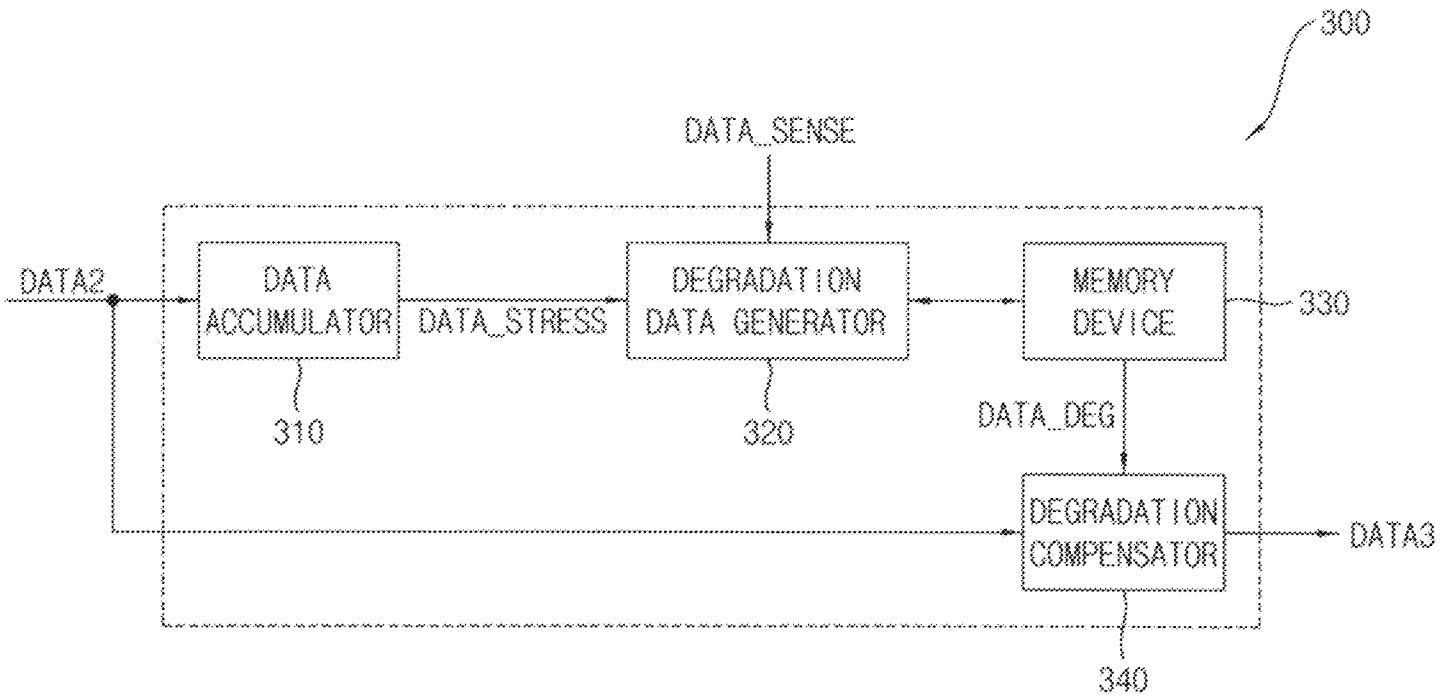
FIG. 3 is a diagram illustrating an example of a compensator included in the display device of FIG. 1.
Figure 4:
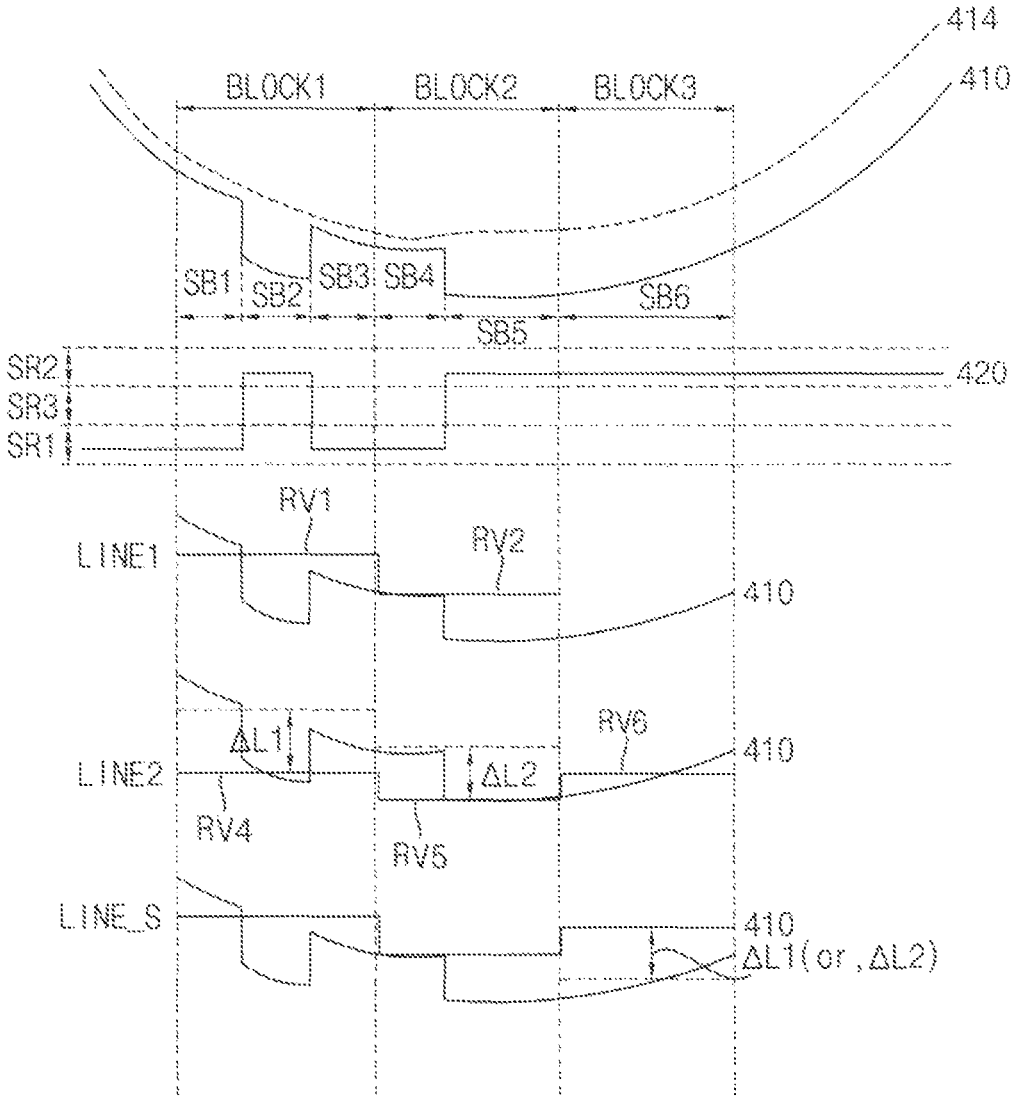
FIG. 4 is a diagram illustrating a process of compensating sensing data by the compensator of FIG. 3.

FIG. 3 is a diagram illustrating an example of a compensator included in the display device of FIG. 1. FIG. 4 is a diagram illustrating a process of compensating sensing data by the compensator of FIG. 3.

Referring to FIGS. 3 and 4, a compensator 300 may include a data accumulator 310, the degradation data generator 320, and a memory device 330. In addition, the compensator 300 may further include a degradation compensator 340.

The data accumulator 310 may generate the stress data DATA_STRESS by calculating a stress (or a stress value) for each of the pixels 111 based on the input data (e.g., the second data DATA2) provided from an external component. Here, the stress may represent a degree of pixel use, and the data accumulator 310 may calculate the stress of a pixel by accumulating grayscale value among the input data corresponding to the pixel. The stress data DATA_STRESS may be provided to the degradation data generator 320 or may be stored in the memory device 330.

In an example embodiment, the data accumulator 310 may reduce (or downscale) the grayscale value (or the input data) and may calculate the stress of the pixel by accumulating the reduced grayscale value (or the downscaled grayscale value). Here, a size of the stress data DATA_STRESS may decrease, and a size of the memory device 330 (or a required size of the memory device 330) storing the stress data DATA_STRESS may decrease.

The degradation data generator 320 may generate the degradation data DATA_DEG by compensating a variation of the sensing data DATA_SENSE based on the stress data DATA_STRESS.

Referring to FIGS. 2 and 4, a fourth graph 410 may represent sensing values which are measured in the first area A1 (or pixel included in the ith pixel row and in the first area A1) of the display panel 220 described with reference to FIG. 2 and may be the same as or substantially the same as the first graph described with reference to FIG. 2. Similarly, a fifth graph 414 may represent a real reference line (or sensing values which are predicted or calculated on assumption that pixels in the ith pixel row are not degraded) for the first area A1.

A sixth graph 420 may represent the stress data DATA_STRESS corresponding to the first area A1 and may include stress values of the pixels included in the first area A1.

The degradation data generator 320 may divide the pixels into groups based on the first block having the first size. For example, the degradation data generator 320 may divide the first area A1 (or the display panel 200) into the groups based on the first block, and first through third groups BLOCK1, BLOCK2, and BLOCK3 may be included in the groups.

The degradation data generator 320 may generate the first reference data by calculating the first reference values for each of the groups based on the first pixels having the first stress value among the stress data DATA_STRESS. For example, the degradation data generator 320 may generate a first reference line LINE1 by calculating the first reference values for each of the first through third blocks BLOCK1, BLOCK2, and BLOCK3 based on the first pixels included in a first stress region SR1 of the sixth graph 420. Here, the first stress region SR1 may include the lowest stress values among the stress data DATA_STRESS or may include the most distributed (e.g., most common, most evenly distributed, most widely distributed) stress values among the stress data DATA_STRESS.

In some example embodiments, the degradation data generator 320 may calculate the first reference values by averaging sensing current values corresponding to the first pixels for each of the groups.

As illustrated in FIG. 4, the degradation data generator 320 may calculate a first sub reference value RV1 for the first group BLOCK1 by averaging the sensing current values of the pixels included in a first sub group SB1 and a third sub group SB3 corresponding to the first stress region SR1 and may calculate a second sub reference value RV2 for the second group BLOCK2 by averaging the sensing current values of the pixels included in a fourth sub group SB4. A third reference value RV3 may not be calculated (or the third reference value RV3 may be invalid) because the third block BLOCK3 may include no pixel corresponding to the first stress region SR1. Therefore, the first reference line LINE1 (or the first sensing data) may include the first sub reference value RV1 for the first group BLOCK1 and the second sub reference value RV2 for the second group BLOCK2.

In addition, the degradation data generator 320 may generate the second reference data by calculating the second reference values for each of the groups based on the second pixels having the second stress value among the stress data DATA_STRESS and may compensate the first reference data based on the second reference data. For example, the degradation data generator 320 may generate a second reference line LINE2 by calculating the second reference values for each of the first through third blocks BLOCK1, BLOCK2, and BLOCK3 based on second pixels included in a second stress region SR2 of the sixth graph 420. Here, the second stress region SR2 may include the second least stress values among the stress data DATA_STRESS (e.g., stress values greater than stress values included in the first stress region SR1) or may include the second most distributed stress values among the stress data DATA_STRESS (e.g., stress values less distributed than stress values included in the first stress region SR1).

As illustrated in FIG. 4, the degradation data generator 320 may calculate a fourth sub reference value RV4 for the first group BLOCK1 by averaging sensing current values of pixels included in a second sub group SB2 corresponding to the second stress region SR2, may calculate a fifth sub reference value RV5 for the second group BLOCK2 by averaging sensing current values of pixels included in a fifth sub group SB5, and may calculate a sixth sub reference value RV6 for the third group BLOCK3 by averaging sensing current values of pixels included in a sixth sub group SB6. Therefore, the second reference line LINE2 (or the second sensing data) may include the fourth sub reference value RV4 for the first group BLOCK1, the fifth sub reference value RV5 for the second group BLOCK2, and the sixth sub reference value RV6 for the third group BLOCK3.

In some example embodiments, the degradation data generator 320 may calculate differences between the first reference values and the second reference values for each of the groups and may compensate the first reference data based on the differences.

In an example embodiment, the degradation data generator 320 may select a first block (or a first group) having a first valid value among the first reference data and having a second valid value among the second reference data, may calculate a first difference between the first valid value and the second valid value, may select a second block (or a second group) having a first invalid value among the first reference data and having a third valid value among the second reference data, may calculate a first compensation value by compensating the third valid value based on the first difference, and may update (or compensate) the first reference data by compensating the first invalid value based on the first compensation value.

As illustrated in FIG. 4, the degradation data generator 320 may calculate a first difference ΔL1 between the first sub reference value RV1 and the fourth sub reference value RV4 of the first group BLOCK1 and may calculate a second difference ΔL2 between the second sub reference value RV2 and the fifth sub reference value RV4 of the second block BLOCK2. After this, the degradation data generator 320 may derive (or obtain) the third sub reference value RV3 of the third group BLOCK3 based on the first difference ΔL1 (and/or the second difference ΔL2) and the second reference data (or the sixth sub reference value RV6 of the third block BLOCK3). For example, the degradation data generator 320 may calculate (or predict) the third sub reference value by summing (or by adding) the sixth sub reference value RV6 and the first difference ΔL1 (or an average of the first difference ΔL1 and the second difference ΔL2, or the second difference ΔL2). Therefore, a compensated first reference line LINE_S (or compensated first reference data) may include the first sub reference value RV1 for the first group BLOCK1, the second sub reference value RV2 for the second group BLOCK2, and the third sub reference value RV3 for the third group BLOCK3.

The degradation data generator 320 may generate final reference data having a resolution which is equal to a resolution of the sensing data by interpolating the compensated first reference data based on the pixels and may generate the degradation data DATA_DEG by subtract the final reference data (or the compensated first reference data) from the sensing data DATA_SENSE. For example, the degradation data generator 320 may generate a final reference line having a form (or a shape) which is similar to a form of the fifth graph 414 (or a real reference line) by interpolating the compensated first reference line LINE_S based on the pixels and may calculate the degradation data based on the fourth graph 410 and the final reference line (or the fifth graph 414).

As described with reference to FIG. 4, the degradation data generator 320 may generate the degradation data DATA_DEG by compensating the variation of the sensing data DATA_SENSE based on the stress data DATA_STRESS.

Referring again to FIG. 3, the memory device 330 may store the stress data DATA_STRESS and the degradation data DATA_DEG and may provide the stress data DATA_STRESS and the degradation data DATA_DEG to some component in response to a request of the some component (e.g., the degradation data generator 320 or the degradation compensator 340).

The degradation compensator 340 may generate converted data (e.g., third data DATA3) by compensating the input data (e.g., the second data DATA2) based on the degradation data DATA_DEG.

In some example embodiments, the degradation data generator 320 may generate the degradation data DATA_DEG at an initial driving of the display device 100 (e.g., immediately after the display device 100 is turned on), the memory device 330 may store (or update) the degradation data DATA_DEG, and the degradation compensator 340 may generate the converted data based on the degradation data DATA_DEG stored in the memory device 330 until the display device 100 is turned off.

As described with reference to FIGS. 3 and 4, the compensator 300 may generate the stress data DATA_STRESS based on the input data (e.g., the second data DATA2) and may generate the degradation data DATA_DEG by compensating the variation of the sensing data DATA_SENSE based on the stress data DATA_STRESS. In addition, the compensator 300 may generate the converted data (e.g., the third data DATA3) by compensating the input data based on the degradation data DATA_DEG. Therefore, the display device 100 may accurately compensate the pixel degradation (or compensate for the pixel degradation) by compensating the variation of the sensing data DATA_SENSE due to a driving condition (e.g., temperature) of the display device 100.

In some example embodiments, the compensator 300 may repeatedly or sequentially operate a process to generate ith reference data by changing a ith stress value among the stress data DATA_STRESS until the first reference data (or the compensated first reference data) has only valid values (or until the first reference data has no invalid value).

Figure 5A:
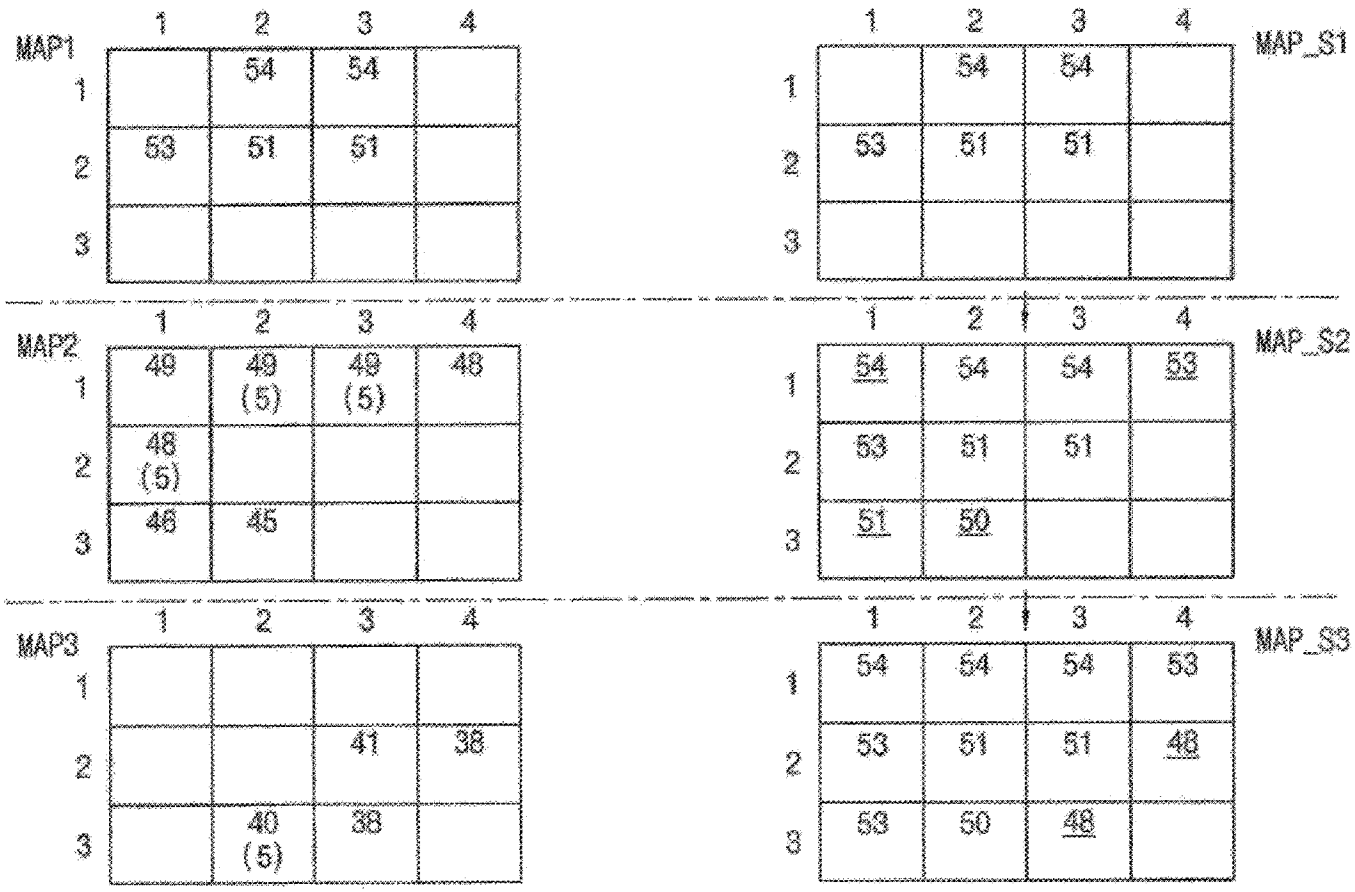
FIG. 5A is a diagram illustrating an example of reference data generated by the compensator of FIG. 3.
Figure 6:
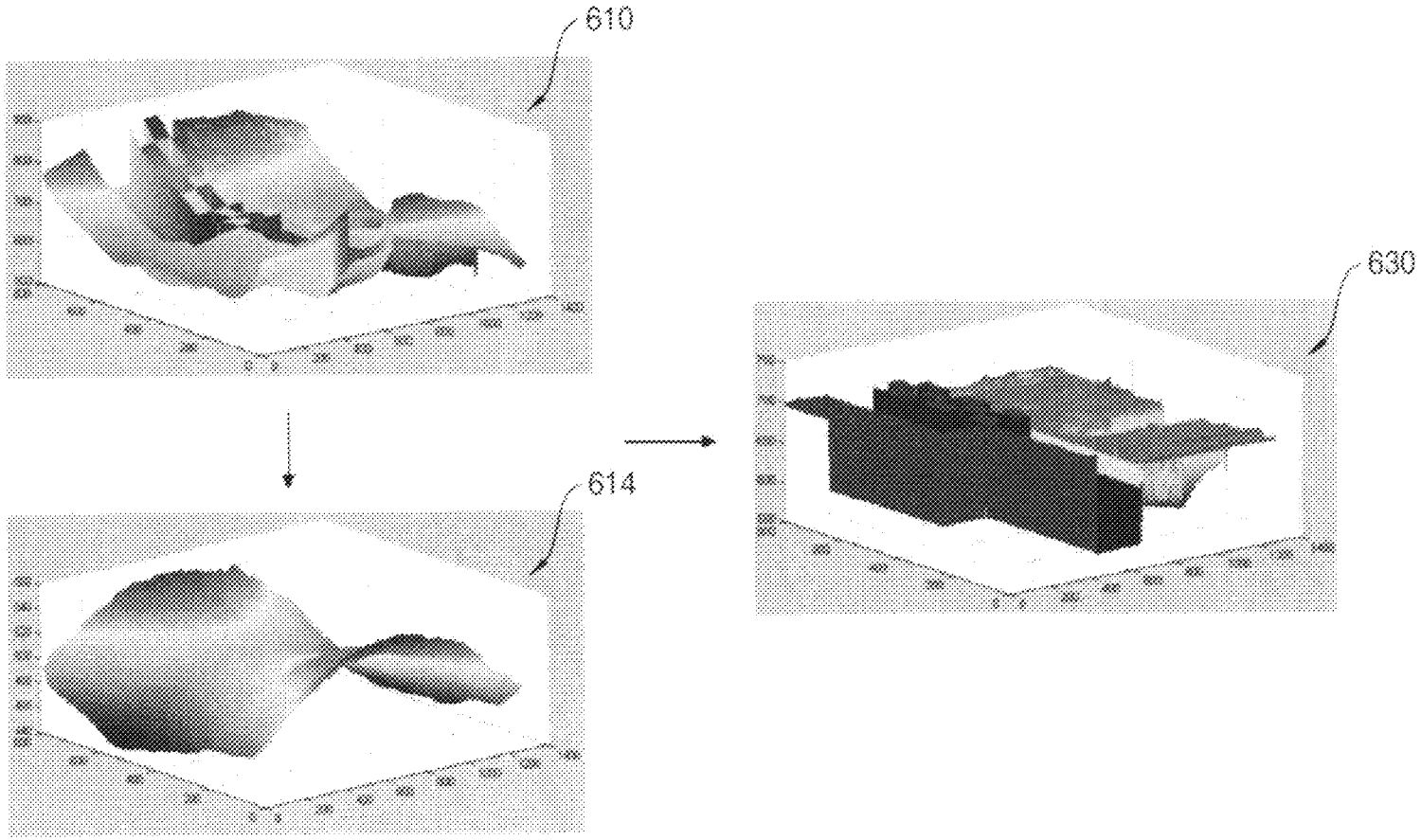
FIG. 6 is a diagram illustrating a process of generating degradation data by the compensator of FIG. 3.

FIG. 5A is a diagram illustrating an example of reference data generated by the compensator of FIG. 3. FIG. 5B is a diagram illustrating an example of reference data generated by the compensator of FIG. 3. FIG. 6 is a diagram illustrating a process of generating degradation data by the compensator of FIG. 3.

Referring to FIGS. 2, 3, 5A, and 5B, the compensator 300 may divide the display panel 200 into twelve groups (or 3 rows×4 columns of groups). In FIG. 4, the reference data is illustrated in one dimension. In FIG. 5A, the reference data is illustrated in two dimensions (or on two-dimensional plane).

A first map MAP1 may represent the first reference data generated by the compensator 300. For example, the first map MAP1 may include first reference values 51, 53, and 54 for a 2-1 group (e.g., a group in second row and in the first column), a 1-3 group, a 1-2 group, a 2-2 group, and a 2-3 group and may include invalid values for a 1-1 group, a 1-4 group, a 2-4 group, and 3-1 through 3-4 groups.

A first compensated map MAP_S1 may represent compensated reference data which is compensated based on the first map MAP1 and may be the same as the first map MAP1.

Because the first map MAP1 (or the first compensated map MAP_S1) has invalid values, the compensator 300 may generate second reference data and may compensate the first map MAP1 (or the first compensated map MAP_S1).

A second map MAP2 may represent the second reference data generated by the compensator 300. For example, the second map MAP2 may include second reference values (e.g., valid values of 45, 46, 48, and 49) for the 1-1 through 1-4 groups, the 2-1 group, the 3-1 group, and the 3-2 group and may include invalid values for the 2-2 through 2-4 groups, the 3-3 group, and the 3-4 group.

Because each of the 1-2 group, the 1-3 group, and the 2-1 group has valid values in the first map MAP1 and in the second map MAP2, the compensator 300 may calculate a difference between the first reference values and the second reference values for the 1-2 group, the 1-3 group, and the 2-1 group, respectively. For example, a 1-2 difference of the 1-2 group, a 1-3 difference of the 1-3 group, and a 2-1 difference of the 2-1 group may be 5, respectively.

Because each of the 1-1 group, the 1-4 group, the 3-1 group, and the 3-2 group has valid values in the second map MAP2 and invalid values in the first map MAP1, the compensator 300 may compensate the first map MAP1 (or the first compensated map MAP_S1) based on a 1-2 difference of the 1-2 group (or a 1-3 difference of the 1-3 group, a 2-1 difference of the 2-1 group, e.g., a value of 5). Therefore, the second compensated map MAP_S2 may include valid values (e.g., 50, 51, 53, and 54) corresponding to the 1-1 group, the 1-4 group, the 3-1 group, and the 3-2 group.

Similarly, because the second compensated map MAP_S2 (or the compensated first map MAP_S1) has invalid values, the compensator 300 may generate third reference data and may re-compensate the first map MAP1 (or the second compensated map MAP_S2).

A third map MAP3 may represent the third reference data generated by the compensator 300. For example, the third map MAP3 may include third reference values (e.g., valid values of 38, 40, and 41) for the 2-3 group, the 2-4 group, the 3-2 group, and the 3-3 group. Because the 3-2 group has valid values in the second map MAP2 and in the third map MAP3, the compensator 300 may calculate a difference between the second reference values and the third reference values for the 3-2 group. On the other hand, because the 2-3 group has valid values in the first map MAP1 and in the third map MAP3, the compensator 300 may calculate a difference between the first reference values and the third reference values for the 2-3 group. After this, the compensator 300 may re-compensate the first map MAP1 (or compensate or re-compensate the second compensated map MAP_S2) based on a difference of the 3-2 group (e.g., a value of 5) (e.g., this value may be combined with the 1-2 difference, the 1-3 difference, or the 2-1 difference), or a difference of the 2-3 group (e.g., a value of 10). Therefore, the third compensated map MAP_S3 may include valid values corresponding to the 1-1 through 3-3 groups.

In FIG. 5*b*, a fourth compensated map MAP_S4 may represent the compensated first map having only valid values.

In some example embodiments, the compensator 300 may select a third block (or a third group) having a second invalid value among the first reference data, may select a fourth block (or a fourth group) adjacent to the third block and having a fourth valid value among the first reference data, and may compensate (or update) the first reference data by compensating the second invalid value based on the fourth valid value. That is, the compensator 300 may compensate (or estimate) invalid values of some blocks (or some groups) using valid values of adjacent blocks (or adjacent groups).

For example, the third compensated map MAP_S3 described with reference to FIG. 5A has a invalid value for the 3-4 group. Here, the compensator 300 may select the 3-3 group adjacent to the 3-4 group and may apply a valid value of the 3-3 group to the 3-4 group. Therefore, the fourth compensated map MAP_S4 may include valid values for all of the groups.

For reference, the compensator 300 may repeat the process above to generate an ith reference data by changing an ith stress value among the stress data DATA_STRESS until the first reference data (or compensated first reference data) has only valid values (or until the first reference data has no invalid values). Here, an accuracy (or reliability, compensation performance) of the degradation data may be improved. Alternatively, the compensator 300 may limit a number of repeating a process of generating the ith reference data and may compensate invalid values of some groups using valid values of adjacent groups. Here, an operation speed (or an operation time) for compensating the pixel degradation may be improved.

A fifth compensated map MAP_S5 may represent a final reference data generated by interpolating the fourth compensated map MAP_S4 based on the pixels. For example, when each of the groups may include nine pixels (or 3×3 pixels), the compensator may calculate a reference value for a 4-6 pixel (or a pixel in a fourth row and in a sixth column) by interpolating a reference value of 54 for the 1-3 group and a reference value of 51 for the 2-1 group.

In some example embodiments, the compensator 300 may generate first supplementary data based on a second block having a second size and may compensate the first reference data based on the first supplementary data.

For example, the compensator 300 may divide the display panel 200 into 108 groups (or groups arranged in 9 rows and in 12 columns) similarly to the fifth compensated map MAP_S5 illustrated in FIG. 5B. Here, the compensator 300 may generate the first supplementary data using a process to compensate the first reference data described with reference to FIG. 5A.

When the first reference data is compensated based on the first supplementary data, accuracy of the degradation data may be improved. Alternatively, when the first supplementary data is not generated (or when the pixel degradation is compensated based on only the first reference data), an operating speed for compensating the pixel degradation may be improved.

Referring to FIG. 6, a first chart 610 may represent the sensing data DATA_SENSE illustrated in 3-dimensional space. A second chart 614 may represent the final reference data (e.g., the fifth compensated map MAP_5S illustrated in FIG. 5B) generated based on the first chart 610 by the compensator 300.

As described with reference to FIG. 3, the compensator 300 may compensate the variation of the sensing data DATA_SENSE by subtracting the final reference data of the second chart 614 from the sensing data DATA_SENSE of the first chart 610. That is, the compensator 300 may generate the degradation data DATA_DEG.

A third chart 630 may represent the degradation data DATA_DEG and may represent the pixel degradation for each of the pixels.

Figure 7:
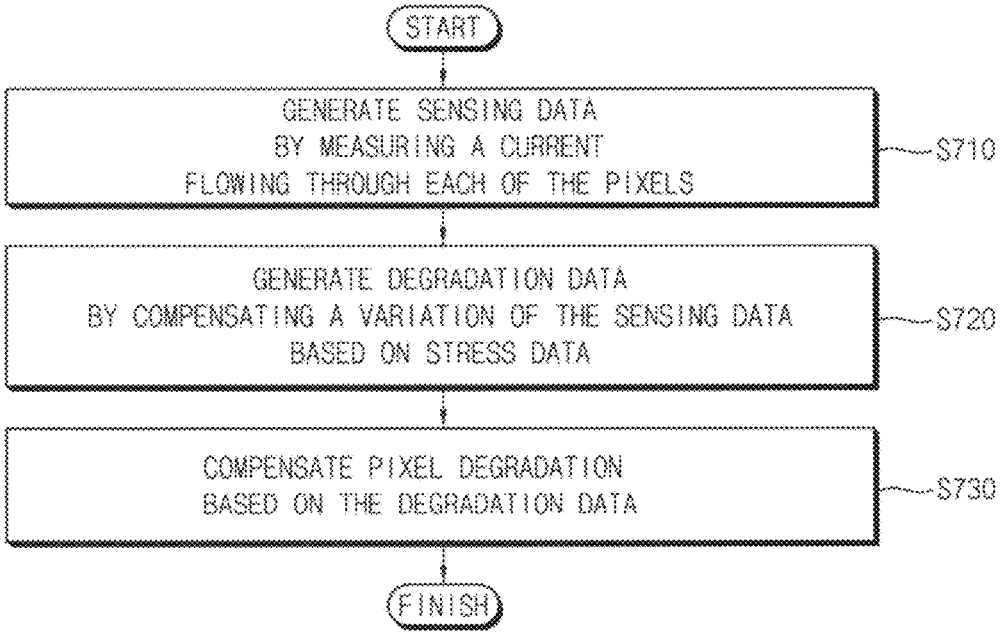
FIG. 7 is a flow diagram illustrating a method of driving a display device according to example embodiments.
Figure 8:
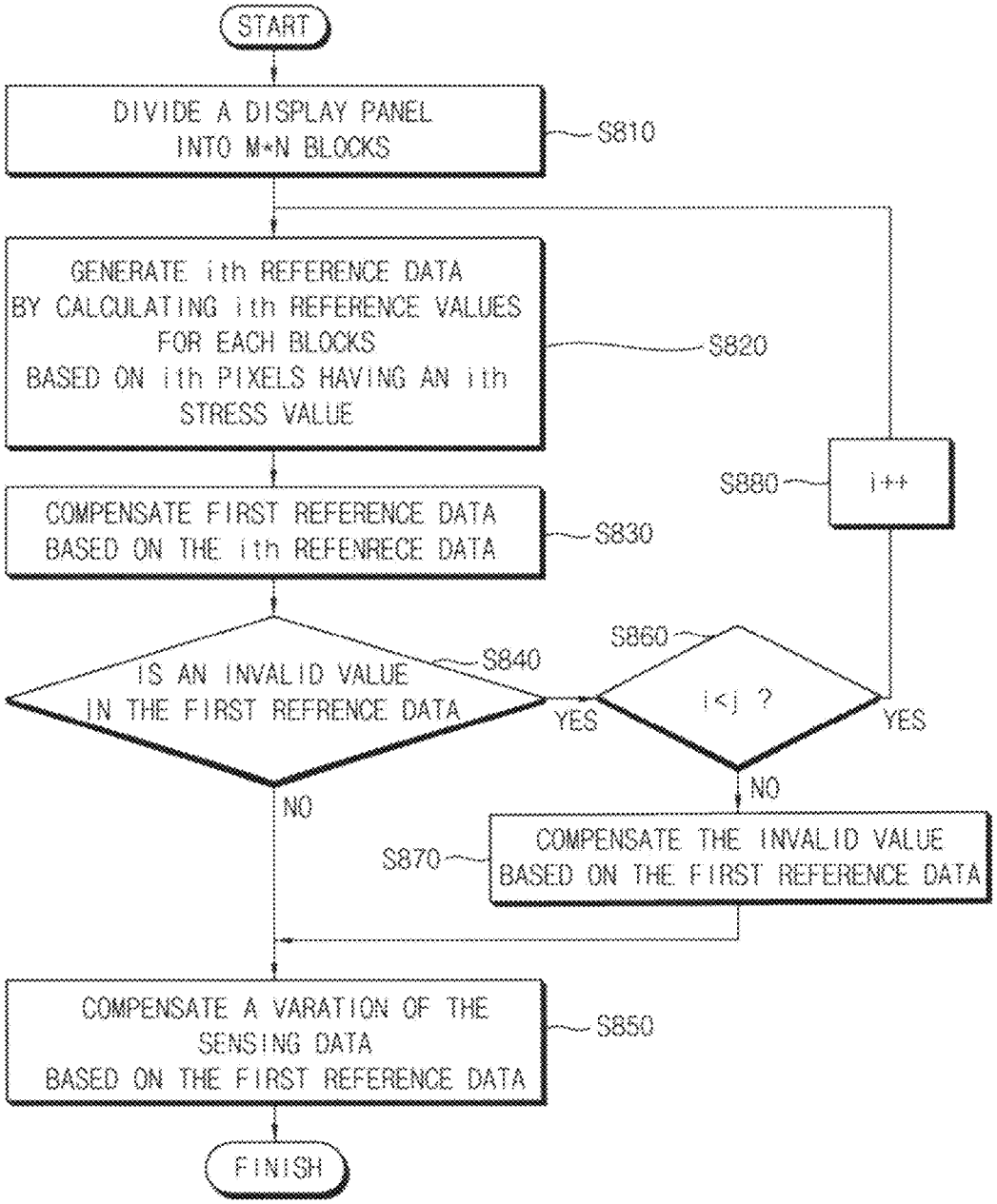
FIG. 8 is a flow diagram illustrating an example in which degradation data is generated by the method of FIG. 7.

FIG. 7 is a flow diagram illustrating a method of driving a display device according to example embodiments. FIG. 8 is a flow diagram illustrating an example in which degradation data is generated by the method of FIG. 7.

Referring to FIGS. 1 and 7, the method of FIG. 7 may be performed by the display device 100 of FIG. 1.

The method of FIG. 7 may generate the stress data DATA_STRESS by calculating the stress of each of the pixels 111 based on the input data (e.g., the second data DATA2) provided from an external component. The stress data DATA_STRESS may be stored in the compensator 170 or in a memory device and may be updated periodically.

The method of FIG. 7 may generate the sensing data DATA_SENSE by measuring a current flowing through each of the pixels 111 in response to a reference voltage (S710). As described with reference to FIG. 1, the method of FIG. 7 may apply the reference voltage (or a sensing voltage) to a feedback line (e.g., an mth feedback line Fm) through the sensor 150 and may generate the sensing data DATA_SENSE by integrating a current which is fed back (passing) through the feedback line in response to the reference voltage.

The method of FIG. 7 may generate the degradation data DATA_DEG by compensating the variation of the sensing data DATA_SENSE based on the stress data DATA_STRESS (S720).

Referring to FIG. 8, the method of FIG. 7 may divide the pixels using a first block having a first size (S810). For example, the method of FIG. 7 may divide the first display panel 110 into M×N groups using the first block.

The method of FIG. 7 may generate ith reference data for each of the groups based on ith pixels having an ith stress value among the stress data DATA_STRESS, where i is a positive integer (S820). For example, the method of FIG. 7 may generate first reference data by calculating first reference values for each of the groups based on first pixels having a first stress value, where the first stress value is the most distributed among the stress data DATA_STRESS. Similarly, the method of FIG. 7 may generate second reference data by calculating second reference values for each of the groups based on second pixels having a second stress value, where the second stress value is the second most distributed among the stress data DATA_STRESS.

The method of FIG. 7 may compensate the first reference data based on the ith reference data (S830). For example, when the first reference data and the second reference data are generated as described with reference to FIGS. 4 and 5A, the method of FIG. 7 may compensate the first reference data based on the second reference data. For example, when only the first reference data is generated, the method of FIG. 7 may store or use the first reference data as it is.

The method of FIG. 7 may determine whether or not an invalid value is in the first reference data (or the compensated first reference data) (S840). When the first reference data includes only valid values, the method of FIG. 7 may compensate the variation of the sensing data DATA_SENSE based on the first reference data (S850). As described with reference to FIG. 6, the method of FIG. 7 may compensate the variation of the sensing data DATA_SENSE and may generate the degradation data DATA_DEG by subtracting the first reference data (or the compensated first reference data) from the sensing data DATA_SENSE.

In an example embodiment, the method of FIG. 7 may compensate the first reference data to have a resolution which is equal to a resolution of the sensing data DATA_SENSE by interpolating the first reference values in the first reference data based on the pixels. That is, the method of FIG. 7 may scale up a block-level resolution of the first reference data into a pixel-level resolution.

In some example embodiments, when the first reference data (or the compensated first reference data) includes invalid values, the method of FIG. 7 may generate kth reference data by changing (or by selecting, by using) a kth stress value different from the first stress value and may compensate the first reference data based on the kth reference data, where k is an integer greater than or equal to 2.

For example, the method of FIG. 7 may select (use) a second stress value which is the second most distributed among the stress data DATA_STRESS (S880), may generate second reference data based on the second stress value (S820), and may compensate the first reference data based on the second reference data (S830).

In some example embodiments, the method of FIG. 7 may compensate an invalid value in the first reference data based on valid values of an adjacent block. Here, the adjacent block may be adjacent to a target block corresponding to the invalid value.

For example, the method of FIG. 7 may determine whether or not a first number is less or smaller than a maximum number (S860). Here, the first number may be a number of times to generate the ith reference data or to repeat a process of generating the ith reference data, and the maximum number may be a number of times to limit generating the ith reference data. When the first number is greater than the maximum number, the method of FIG. 7 may compensate the invalid value of the target block based on the valid value of the adjacent block (S870). The method of FIG. 7 may improve an operation speed of compensating the pixel degradation by limiting a number of times of generating the ith reference data and by compensating the invalid value of the target block based on the valid value of the adjacent block.

Referring again to FIG. 7, the method of FIG. 7 may compensate the pixel degradation (or compensate for the pixel degradation) based on the degradation data DATA_DEG (S730). As described with reference to FIG. 3, the method of FIG. 7 may generate the converted data (e.g., the third data DATA3) by compensating the input data (e.g., the second data DATA2) based on the degradation data DATA_DEG. Here, the method of FIG. 7 may generate the data signal based on the converted data using the data driver 130 and may provide the data signal to the pixels 111.

As described with reference to FIGS. 7 and 8, the method of driving a display device according to example embodiments may generate the degradation data by compensating the variation of the sensing data DATA_SENSE based on the stress data DATA_STRESS. Therefore, the method may accurately compensate the pixel degradation (or compensate for the pixel degradation) because the variation of the sensing data DATA_SENSE due to a driving condition of the display device 100 (e.g., temperature). In addition, the method may improve the operation speed for compensating the pixel degradation and may drive the display device more efficiently by limiting a number of times to generate reference data and by estimating the reference data in a process of generating the reference data to compensate the variation of the sensing data DATA_SENSE.

The present inventive concept may be applied to any electronic devices including a display device. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device comprising:

a display panel comprising pixels;

a sensor configured to generate sensing data by measuring a current flowing through each of the pixels based on a reference voltage; and a compensator configured to:

generate stress data by calculating stress of the pixels based on input data provided from an external component;

divide the pixels into groups using a first block having a first size;

generate first reference data by calculating first reference values for the groups based on first pixels of the pixels in the groups having a first stress value among the stress data; and generate degradation data based on the sensing data by compensating a variation in the sensing data based on the first reference data.

2. The display device of claim 1, wherein the variation of the sensing data varies depending on at least one of characteristic variation of the pixels and a driving condition of the display device.

3. The display device of claim 1, wherein the first stress value is the most distributed in the stress data.

4. The display device of claim 1, wherein the first stress value is the lowest value in the stress data.

5. The display device of claim 1, wherein the compensator calculates the first reference values by averaging sensed current values corresponding to the first pixels in the sensing data for each of the groups.

6. The display device of claim 1, wherein the compensator is to generate second reference data by calculating second reference values for the groups based on second pixels of the pixels in the groups having a second stress value among the stress data and compensate the first reference data based on the second reference data.

7. The display device of claim 6, wherein the compensator calculates differences between the first reference values and the second reference values corresponding to respective groups and compensates the first reference data based on the differences.

8. The display device of claim 7, wherein the compensator is to:

select a first group of the groups having a first valid value in the first reference data and a second valid value in the second reference data;

calculate a first difference between the first valid value and the second valid value;

select a second group of the groups having a first invalid value in the first reference data and a third valid value in the second reference data;

calculate a first compensation value by compensating the third valid value based on the first difference; and update the first reference data by compensating the first invalid value based on the first compensation value.

9. The display device of claim 8, wherein the compensator is to:

select a third group of the groups having a second invalid value in the first reference data;

select a fourth group of the groups adjacent to the third group and having a fourth valid value in the first reference data; and update the first reference data by compensating the second invalid value based on the fourth valid value.

10. The display device of claim 1, wherein the compensator is to generate first supplementary data based on a second block having a second size and compensates the first reference data based on the first supplementary data.

11. The display device of claim 1, wherein the compensator is to compensate the first reference data to have a resolution which is equal to a resolution of the sensing data by interpolating the first reference values based on the pixels.

12. The display device of claim 11, wherein the compensator generates the degradation data by subtracting the first reference data from the sensing data.

13. The display device of claim 1, wherein the compensator generates the degradation data when the display device is initially driven.

14. The display device of claim 1, further comprising:

a data driver configured to generate a data signal based on converted data and to provide the data signal to the pixels, wherein the compensator is to generate the converted data by compensating the input data based on the degradation data.

15. A method of driving a display device including pixels, the method comprising:

generating stress data by calculating stress of each of the pixels based on input data provided form an external component;

generating sensing data by measuring a current flowing through each of the pixels in response to a reference voltage;

dividing the pixels into groups using a first block having a first size;

generating first reference data by calculating first reference values for the groups based on first pixels of the pixels in the groups having a first stress value among the stress data;

generating degradation data based on the sensing data by compensating a variation in the sensing data based on the first reference data; and compensating degradation of the pixels based on the degradation data.

16. The method of claim 15, wherein generating the first reference data includes:

generating second reference data by calculating second reference values for the groups based on second pixels of the pixels in the groups having a second stress value of the stress data; and compensating the first reference data based on the second reference data.

17. The method of claim 16, wherein generating the first reference data further includes:

compensating an invalid value of the first reference data based on a valid value of an adjacent group of the groups, and wherein the adjacent group is adjacent to a target group of the groups corresponding to the invalid value.

18. The method of claim 15, wherein generating the first reference data includes:

compensating the first reference data to have a resolution which is equal to a resolution of the sensing data by interpolating the first reference values based on the pixels.

* * * * *